United States Patent [19]

Mawby et al.

[11] Patent Number: 4,555,049

[45] Date of Patent: Nov. 26, 1985

[54] ICE DOOR MECHANISM

[75] Inventors: Harold S. Mawby; Carl W. Frisbie, both of Belding, Mich.

[73] Assignee: White Consolidated Industries, Inc., Cleveland, Ohio

[21] Appl. No.: 571,679

[22] Filed: Jan. 18, 1984

[51] Int. Cl.[4] ..... F25C 5/18

[52] U.S. Cl. ..... 222/517; 222/547; 222/505; 222/146.6

[58] Field of Search ..... 62/344; 49/383; 222/447, 477, 517, 505, 556, 226, 228, 230, 231, 547, 146.6, 508

[56] References Cited

U.S. PATENT DOCUMENTS

| | | | |
|---|---|---|---|
| 1,444,398 | 2/1923 | Shepherd | 49/383 |
| 1,626,844 | 5/1927 | Kuhn | 49/383 |
| 2,770,398 | 11/1956 | Sauerman | 222/517 |
| 3,537,273 | 11/1970 | Alvarez | 62/344 |
| 4,220,266 | 9/1980 | Braden et al. | 222/477 |

FOREIGN PATENT DOCUMENTS

| | | | |
|---|---|---|---|
| 620030 | 4/1927 | France | 49/383 |

*Primary Examiner*—H. Grant Skaggs

*Attorney, Agent, or Firm*—Pearne, Gordon, Sessions, McCoy, Granger & Tilberry

[57] ABSTRACT

In a refrigerator having a cabinet which defines an opening, an ice dispensing apparatus within the opening dispenses ice pieces through a delivery chute. An inner ice door is mounted on hinges within the delivery chute and movable to a first position which blocks the delivery chute from the passage of ice pieces, or to a second position which allows the passage of ice pieces through the delivery chute. An ice guard is provided which protects the hinges from ice pieces which pass from the ice dispensing apparatus through the delivery chute, as well as from becoming frozen in the first closed position. The ice guard comprises a sweeper member which is biased against the inner ice door and sweeps against it as the inner ice door is moved from the first to the second position, thus removing any ice pieces or water from the inner ice door.

8 Claims, 7 Drawing Figures

ICE DOOR MECHANISM

BACKGROUND OF THE INVENTION

This invention relates to ice piece dispensers for domestic refrigerators, and more particularly to an apparatus which protects the hinge mechanism of the door from damage resulting from the movement of ice which is being dispensed.

Many homeowners enjoy the convenience of owning a household refrigerator with an automatic ice maker which delivers "ice cubes" to an exterior service area in front of the door. An example of such a through-the-door ice piece dispenser is disclosed in U.S. Pat. No. 4,220,266, issued Sept. 2, 1980 to Braden et al, wherein the automatic ice maker is located in the freezer compartment of a side-by-side refrigerator. The ice pieces are dispensed from a storage bin and fall by gravity through the door passage and enter the service area for collection in a suitable container by the operator. In particular, the Braden et al patent shows a mechanism for a closure member or ice door which is used to seal the ice passage or chute in the refrigerator cabinet. The present application relates to a guard to shield the hinge of the closure member from ice pieces which are delivered through the ice drop passage in the refrigerator cabinet.

It is necessary in refrigerator ice dispensing arrangements to provide a closure member or door to seal the passageway. This closure member prevents the flow of room temperature air through the service area into the freezer ice piece storage bin, as well as preventing atropying ice from traveling through the passageway in the refrigerator door into the service area, where it will melt and leave a pool of water.

The above-mentioned Braden patent discloses such a closure member, which is hinged away from the opening of the ice drop passage in the refrigerator cabinet. Upon the pushing of an actuator, the closure member is swung open upwardly to allow ice pieces to pass from the upper ice passageway in the refrigerator cabinet into the lower ice passageway in the refrigerator door. Some ice pieces may continue to fall through the upper ice passageway as the closure member is swinging shut, or even after it has closed. Thus, in the Braden et al patent, it is possible that ice pieces may fall from the upper passageway into the closure member cavity in the refrigerator door instead of following the lower passage, and become trapped behing the closure member. This presents several problems: the ice piece may become wedged between the closure member and the closure member support, which prevents the closure member from achieving its fully open position; the ice piece may melt and refreeze, locking the closure member into its closed position. While both possibilities are frustrating to the refrigerator owner in and of themselves, the real danger with either situation is that the refrigerator owner will apply an extreme amount of pressure to the operating actuator in an attempt to open the closure member and the ice passageway, and as a result will permanently damage the camming mechanism which causes the closure member to be opened.

Therefore, an object of the present invention is to shield the hinging mechanism of the closure member from ice pieces which are dispensed through the passageway in the refrigerator cabinet.

Another object of the present invention is to retain ice pieces in the closure member cavity closer to the passageway which leads from the in storage area in the colder area of the closure member cavity in order to avoid ice cubes melting into the hinge mechanism.

It is an object of the invention as well that the closure member periodically be swept clean of any ice pieces or accumulated water.

In order to meet the preceding objects a pivoting guard or shield is provided which is spring-biased against the top of the closure member. The guard shields the hinge mechanism of the closure member from falling ice pieces, and also sweeps along the top of the closure member as the closure member is opened in order to wipe off any ice pieces or water which might be on the top of the ice door.

Further objects and advantages of the present invention will become more apparent from the following specification, reference being had to the accompanying drawings.

DETAILED DESCRIPTION OF THE PREFERRED EMBODIMENT

Figure 1:
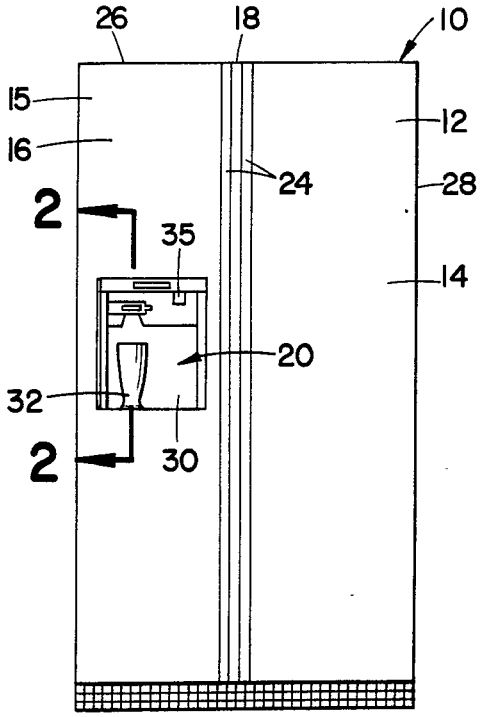
FIG. 1 is a front elevational view of a side-by-side refrigerator incorporating the present invention.

Referring now to the drawings, and especially FIG. 1, there is shown a refrigerator cabinet 10 generally referred to as a side-by-side refrigerator having an opening containing a fresh food compartment 12 closed by a righthand access door 14 and a freezer compartment 15 closed by a lefthand door 16, separated by a vertically disposed insulating partition 18. A recessed service area 20 is provided in the face of the freezer door 16, as shown and described in the above-mentioned U.S. Pat. No. 4,220,266, which is now assigned to the same assignee as the instant application, and the disclosure of which is incorporated by reference herein.

The cabinet doors include door handles 24, while an outer metal shell provides an insulated top outer wall 26, a back wall (not shown) and sidewalls 28.

In the disclosed embodiment, the service area 20 includes a housing member 30, preferably formed of plastic material located in the door 16. The housing member 30 defines the recessed service area 20 such that a suitable receptacle, such as a drinking glass 32, may be positioned on the shelf of the service area for receiving ice pieces from an ice dispensing apparatus by depressing an actuator to be described.

A water dispensing device 35 may also be provided. An example of such a device is shown in U.S. Pat. No.

4,036,620 to Benasutti et al, issued July 19, 1977 and now assigned to the assignee of the present invention.

Figure 2:
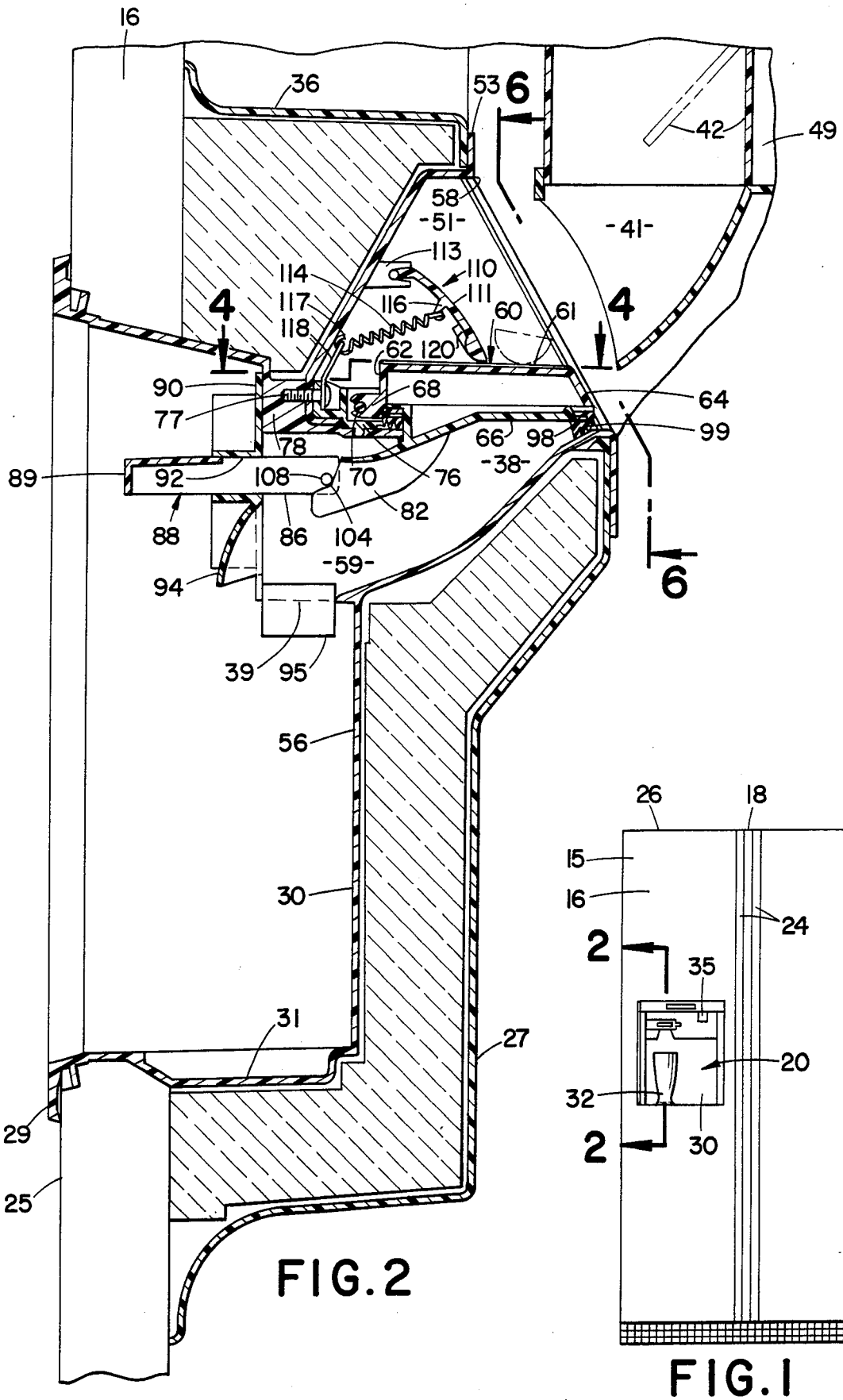
FIG. 2 is an enlarged, fragmentary, vertical sectional view, taken generally along line 2—2 of FIG. 1, showing the closure member in its closed position.

As seen in FIG. 2, the freezer door 16 includes an outer sheet metal wall 25 of hollow construction, while the inner wall of the door is provided with a door pan 27 of suitable sheet plastic material. Housing member 30 defines the walls of the service area and includes a mounting flange 29 and a drip recess 31. On the inside of door 16, door pan 27 defines an enclosure 36 which is recessed in the door 16 of the refrigerator and is located substantially coextensively with the service area 20. A forwardly inclined ice piece delivery chute 37 allows the passage of ice pieces from the storage bin 49 in the freezer inside of the refrigerator cabinet through the outer lower exit 39 and into the receptacle 32. The ice piece delivery chute 37 consists of an upper passageway 41 and a lower passageway 59. This lower passageway 59 forms a channel for the ice in the lower inner opening 38. The lower inner opening 38 passes through the enclosure 36 in the door 16 and consists of cavity 51 and lower passageway 59.

Figure 3:
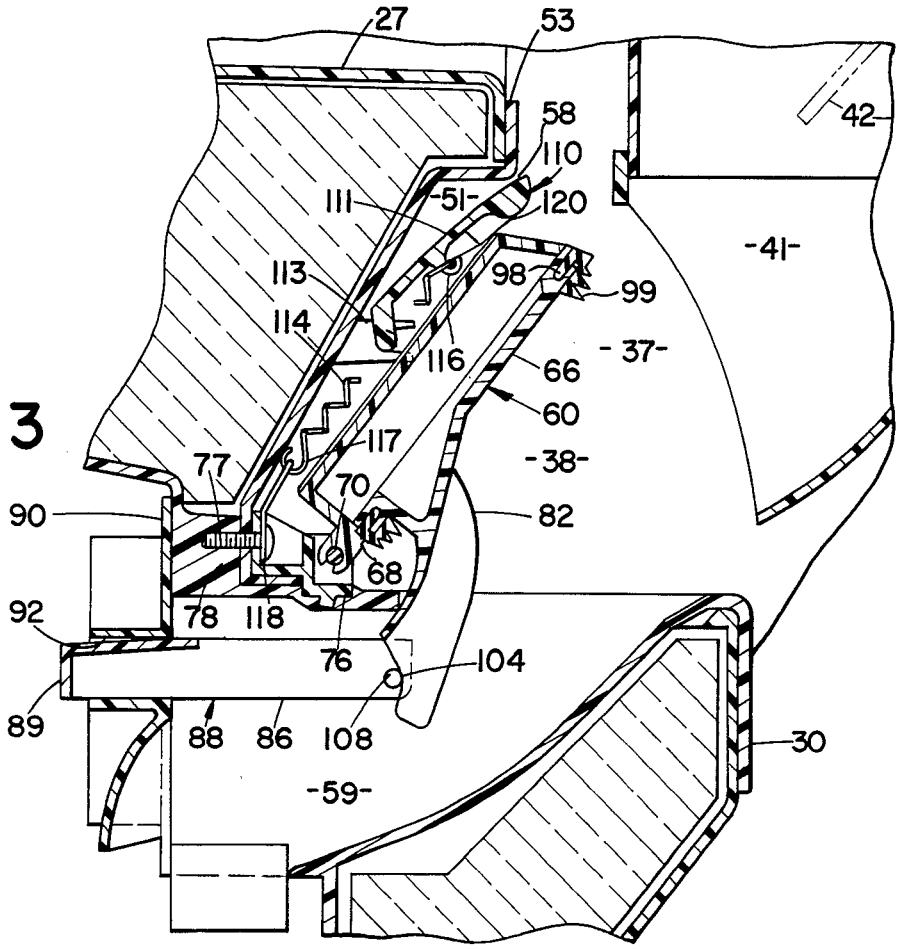
FIG. 3 is an enlarged fragmentary, sectional view, taken generally along line 2—2 of FIG. 1, showing the closure member in its open position.

The bottom wall of the lower inner opening 38 is formed by the housing member 30. As can be seen in FIGS. 2 and 3, the top wall of the lower inner opening 38 is formed by a liner 52. The lower inner opening 38 includes cavity 51 which houses the ice guard assembly 110, as well as the inner door or closure member 60 when it is in an open position. The cavity 51 is defined by a liner 53 which is made of suitable moldable molded plastic material.

A storage container or bin 49 is provided to store the ice pieces until they are dispensed. For details of one such ice dispensing device and storage bin arrangement, reference may be had to U.S. Pat. No. 3,887,119, issued to J. S. Sucro et al on June 3, 1975, and now assigned to the assignee of the present application.

Referring to FIGS. 2 and 3, an exit opening 42 of the ice storage container bin 49 is located at the forward end portion of an ice piece dispenser arrangement.

The lower inner opening 38 includes lower passageway 59 along the surface of enclosure 36, which extends from an opening 58 along the inside of the refrigerator door to the rear wall 56 of the service area for conveying ice pieces discharged through the upper passageway 41 into the service area 20.

With reference to FIG. 2, lower passageway 59 is provided with closure means in the form of an insulated closure member or inner door 60 operable when in its horizontal closed position (FIG. 3) to close in a sealed manner the entrance of lower passageway 59.

Figure 4:
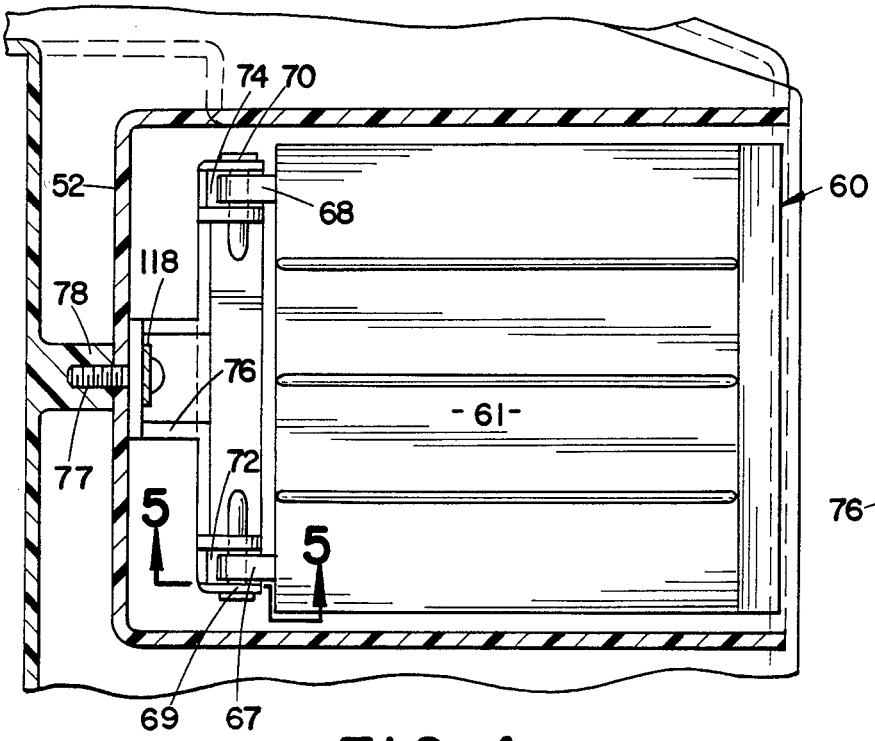
FIG. 4 is a bottom plan view of the closure member showing its hinged connection.
Figure 5:
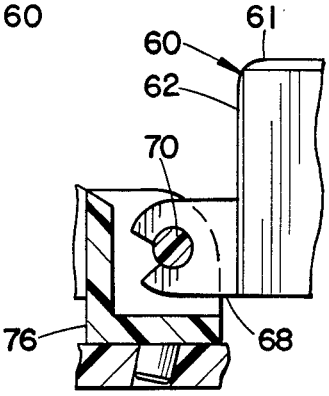
FIG. 5 is an enlarged, fragmentary portion of FIG. 4, taken generally along the line 5—5 of FIG. 4, showing the hinge connection of the closure member.
Figure 6:
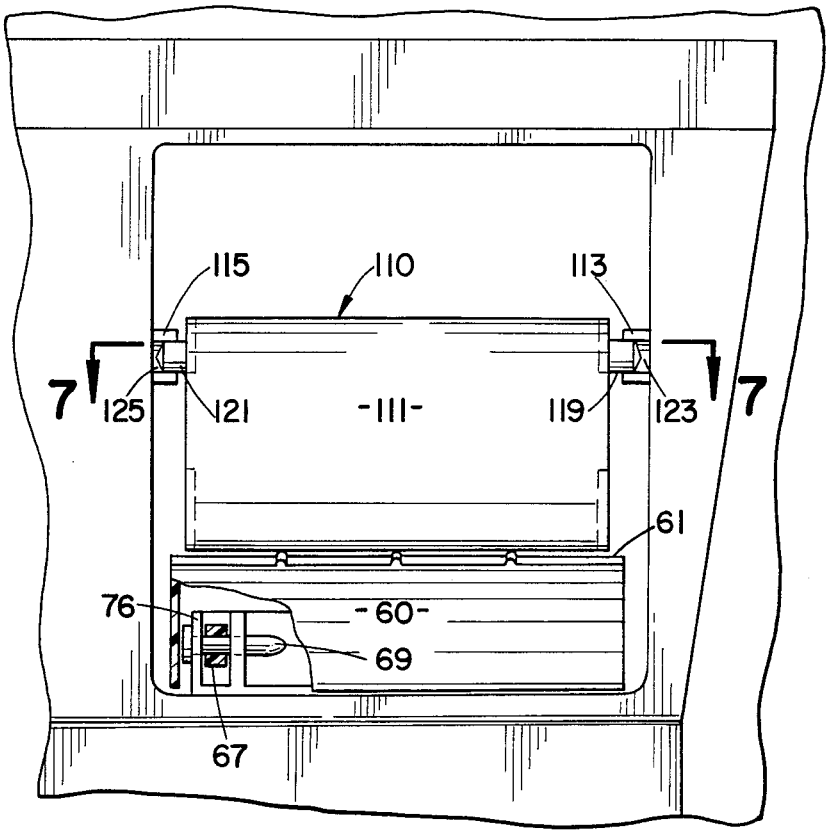
FIG. 6 is a front elevational view, taken along line 6—6 of FIG. 2, showing the ice door scraper and ice door in the closed position, the ice door being partially broken away to show the hinge mechanism.
Figure 7:
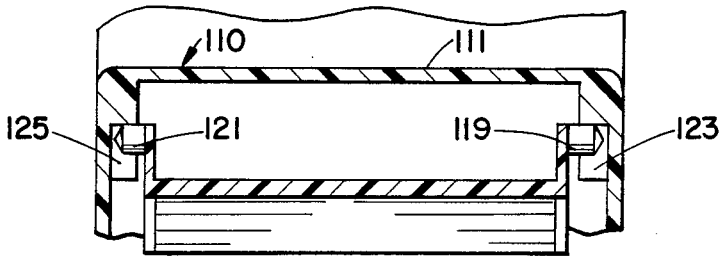
FIG. 7 is a fragmentary, vertical, sectional view, taken generally along line 7—7 of FIG. 6.

The upper wall 61 of the closure member 60 is shown as a plastic sheet having downwardly formed front and rear flanges 62 and 64 receiving the edges of the bottom panel 66, formed preferably of plastic material. The closure member 60 is pivotably connected to the inside of the refrigerator door by joining or hinge means. These hinge means are connected to the front flange 62 and consist of a pair of forwardly extending spaced ears 67 and 68 provided with aligned apertures for receiving transverse pin members 69 and 70, the outer ends of which are fixedly received in slots 72, 74 of hinge bracket 76, as can be seen in FIG. 4.

As seen in FIGS. 2 and 3, the hinge bracket 76 is secured as by screw 77 to support member 78. The closure member 60 hinge means thus allows the closure member to swing or pivot from a first position closing the lower passage 59 against the passage of ice pieces to an upwardly and rearwardly inclined second position, where it clears the lower passageway 59 for the reception of ice pieces from the dispenser. It is important that the closure member 60 swing smoothly upward to ensure the proper dispensing of ice through the lower passageway 51.

It is preferable that the transverse pin members 69 and 70 form an integral part of the hinge bracket 76, and further that the spaced ears 67 and 68 form one body with the front flange 62 of the closure member 60. The hinge means are preferably formed of plastic material.

The closure member 60 actuating means includes a pair of longitudinally extending, arcuate ribs 82 integrally formed on either side of the bottom panel 66 positioned in the passageway 59 so as to project forwardly beyond the wall 56 of the service area for cooperative engagement with the parallel legs 86 of a U-shaped actuator 88 movably supported in service area face plate 90. The U-shaped actuator 88, which includes an operating bight portion or bar 89 connecting the spaced parallel legs 86, is slidably received for reciprocal movement in a rectangularly shaped conforming aperture 92 formed in the cover or face plate 90. A downwardly extending outwardly convexed deflector portion 94 integral with the face plate and side guides 95 serves to channel ice pieces vertically downwardly into the service area 20 through the access exit 39 of the lower passageway 59.

Each of the arcuate ribs 82 has a notched cam surface 104 formed at its upper edge for engaging transversely projecting studs 108 integrally formed on the inner surface of the actuator legs 86. In this way, opening of the closure member 60 is achieved about pins 69 and 70, resulting in the pivotable movement of closure member 60 to its position of FIG. 3 upon the user's pushing in on the actuator bar.

As seen in FIGS. 2 and 3, the closure member 60, bottom panel 66 peripheral edges are formed with an outwardly facing molded slot 98 for reception of a flexible gasket 99 providing a substantially airtight seal for the lower passageway 59 when the closure member is in its horizontal closed position.

With reference to FIG. 3, it will be seen that upon full inward travel of the actuator 88, pivotable movement between the arcuate ribs 82 and their associated actuator leg studs 108 is achieved, resulting in movement of the closure member to its upwardly and rearwardly inclined open position.

Referring now to FIG. 2, the ice guard assembly 110 consists of an ice door sweeper member 111, one end of which sweeps along the substantially planar upper surface 61 of the closure member 60 as the closure member is raised into its upright open position, and the other end of which is pivotably connected by means of brackets 113, 115 to liner 53. The ice guard assembly also includes means to bias the door sweeper against the door, such as spring 114, which is hooked on one end to the ice door sweeper hook 116 and fastened on the other end to spring retaining flange 118 by means of spring hook 117. The spring retaining flange 118 extends upward into the cavity 51 parallel to the liner 53 and is secured to support member 78 by the same screw 77 which secures hinge bracket 76 to the support member 78 and the liner 53 to the support member 58.

As the actuator 89 is depressed and the closure member 60 is raised, as discussed above, the closure member 60 presses against the ice door sweeper member 111 to cause it to pivot about its pivots at 113, 115 into an upwardly inclined position, as shown in FIG. 3. The end of the ice door sweeper member 111, which rests against the closure member 60, has a rounded contour to facilitate the following motion of the ice door sweeper member 111 as the closure member 60 is opened. The ice door sweeper member 111 further has a rib 120 which causes the ice door sweeper member 111 to be inclined sufficiently upward to block the entry in the cavity 51 by ice pieces when the closure member 60 is in its upright position.

In the event that an ice cube or an ice piece is dispensed after the closure member 60 blocks lower passageway 59 and is thus trapped on the top of the closure member 61, the ice door sweeper member 111 will prevent the ice piece from tumbling down into the hinge mechanism or from sliding down the closure member into the hinge mechanism as the closure member 60 is next opened. Instead, the ice door sweeper member 111 will have the effect of sweeping the ice piece over the edge of the closure member 60 along the front flange 64 and back into the lower passageway 59.

In FIG. 4, it can be seen that there are slots 72, 74 into which the ears 67 and 68 of the closure member 60 protrude and through which hinge pins 70 and 71 extend and in which pieces of ice could become trapped. In such circumstance, if pressure is applied, the hinge mechanism will be damaged and will no longer work correctly.

The ice door sweeper member 111 is pivotably joined to the liner 52 of the inner cavity 51 by means of a left and right integrally formed stud 119, 121, which cooperated with right and left brackets 113 and 115. The brackets 113 and 115 each have a slot 123 and 125, respectively. The studs 119 and 121 slide into the slot 123 and 125 and are retained against the back of the slot 123, 125 by means of the spring 114, which exerts a downward and backward pressure on the ice door sweeper member 111.

Although the preferred embodiment of this invention has been shown and described, it should be understood that various modifications and rearrangements of the parts may be resorted to without departing from the scope of the invention as disclosed and claimed herein.

What is claimed is:

1. A refrigerator having a cabinet defining an opening;

a main door mounted on said cabinet to close said opening;

an ice dispensing apparatus in said chamber;

a delivery chute in said main door;

an inner door movable to a first substantially horizontal closed position to block said delivery chute against the passage of ice pieces therethrough and pivotably mounted to allow the inner door to be placed in a second open position allowing the passage of ice through said delivery chute;

joining means pivotably joining the inner door to a support member within said delivery chute;

an ice guard comprising a sweeper member which is pivotably mounted on a bracket within said delivery chute, the sweeper member having a portion extending substantially the width of and resting on said inner door movable relative to said inner door, and the sweeper member being resiliently biased against said inner door to sweep along the inner door as the inner door is moved between the first and second position.

2. A refrigerator according to claim 1, wherein the sweeper member has an integrally formed hook;

a retaining flange extends from said support member toward the bracket; and a spring is fastened between the retaining flange and the hook.

3. A refrigerator according to claim 2 wherein the retaining flange and the support member are secured by a single screw.

4. A refrigerator having a cabinet defining an opening;

a main door mounted on said cabinet to close said opening;

an ice dispensing apparatus in the chamber;

a delivery chute in the main door, the delivery chute having a cavity area;

an inner door carried on the main door in the delivery chute;

joining means securing one end of the inner door in place and allowing the inner door to be moved between a first substantially horizontal position closing the chute and a second substantially upright position in the cavity area of the delivery chute, the second position allowing ice to pass from the dispensing apparatus through the delivery chute to the exterior of the main door; and an ice guard located within the cavity area and comprising a sweeper member having one end which sweeps along the inner door as the inner door is moved between the first and second position, the ice guard protecting the joining means from ice pieces which are dispelled through the opening.

5. A refrigerator according to claim 4, wherein said sweeper member is biased against said inner door by means of a spring.

6. A refrigerator according to claim 4, wherein said inner door has a substantially planar upper surface and is pivotably mounted in said delivery chute;

said ice guard consisting of a substantially planar member having one end having a rounded contour which rests on said inner door and being pivotably mounted in said delivery chute between said inner door and said ice dispensing apparatus; and said planar member forms an obtuse angle with the substantially planar upper surface of said inner door.

7. A refrigerator as set forth in claim 4, wherein the ice guard includes means to block the entry of ice in the cavity when the closure member is in its upright position.

8. A refrigerator as set forth in claim 7 wherein the one end of the sweeper member has a rounded contour and the means to block the entry of ice in the cavity when the closure member is in its upright position is a rib extending from the bottom of the ice guard.

* * * * *